US010716173B2

(12) United States Patent
Jeanneteau et al.

(10) Patent No.: US 10,716,173 B2
(45) Date of Patent: Jul. 14, 2020

(54) METHOD FOR CALIBRATING A POWER CONTROL LOOP OF AN INDUCTION HOB

(71) Applicant: ELECTROLUX APPLIANCES AKTIEBOLAG, Stockholm (SE)

(72) Inventors: Laurent Jeanneteau, Forli (IT); Massimo Nostro, Forli (IT); Massimo Zangoli, Forli (IT); Alex Viroli, Forli (IT)

(73) Assignee: Electrolux Appliances Aktibolag, Stockholm (SE)

( * ) Notice: Subject to any disclaimer, the term of this patent is extended or adjusted under 35 U.S.C. 154(b) by 196 days.

(21) Appl. No.: 15/558,710

(22) PCT Filed: Apr. 21, 2016

(86) PCT No.: PCT/EP2016/058880
§ 371 (c)(1),
(2) Date: Sep. 15, 2017

(87) PCT Pub. No.: WO2016/177583
PCT Pub. Date: Nov. 10, 2016

(65) Prior Publication Data

US 2018/0116014 A1 Apr. 26, 2018

(30) Foreign Application Priority Data

May 7, 2015 (EP) ..... 15166739

(51) Int. Cl.
*H05B 1/02* (2006.01)
*H05B 6/06* (2006.01)
*F24C 7/06* (2006.01)

(52) U.S. Cl.
CPC ..... *H05B 6/062* (2013.01); *F24C 7/06* (2013.01); *H05B 1/0202* (2013.01); *H05B 2213/07* (2013.01)

(58) Field of Classification Search
CPC .. F24C 7/06; H05B 6/062; H05B 6/06; H05B 6/08; H05B 1/0202; H05B 2213/07
(Continued)

(56) References Cited

U.S. PATENT DOCUMENTS 3,097,283 A * 7/1963 Giacchetti ..... H05B 6/06 219/662
4,396,818 A 8/1983 Kominami et al.
(Continued)

FOREIGN PATENT DOCUMENTS

| | | |
|---|---|---|
| EP | 0354151 | 2/1990 |
| EP | 2706816 | 3/2014 |
| FR | 2168951 | 9/1973 |

OTHER PUBLICATIONS

International Search Report for PCT/EP2016/058880, dated Jun. 28, 2016, 2 pages.
(Continued)

*Primary Examiner* — Mark H Paschall
(74) *Attorney, Agent, or Firm* — Pearne & Gordon LLP

(57) ABSTRACT

The invention relates to a method for calibrating a power control loop of an induction hob (1), the induction hob (1) comprising a power stage (10) including at least one induction element (21), a measurement unit (12) and a control unit (11), the method comprising the steps of: —coupling the at least one induction element (21) with a reference load; —powering the power stage (10) at predefined working conditions by means of said control unit (11); —deriving a measurement value being indicative for the power transferred from the power stage (10) to the reference load by means of said measurement unit (12); —providing the measurement value to the control unit (11); —calculating a correction value based on the measurement value and a reference value; —storing the correction value in a storage entity in order to modify measurement values provided by
(Continued)

the measurement unit (12) based on the correction value when operating the induction hob (1).

17 Claims, 5 Drawing Sheets

(58) Field of Classification Search
USPC ..... 219/507, 621, 660, 661, 664, 665, 667
See application file for complete search history.

(56) References Cited

U.S. PATENT DOCUMENTS

| | | | | |
|---|---|---|---|---|
| 9,174,299 | B2 * | 11/2015 | Groft | B23K 13/025 |
| 2010/0288011 | A1 | 11/2010 | Groft et al. | |
| 2014/0158678 | A1 * | 6/2014 | Thomann | H05B 1/0266 219/627 |
| 2016/0216180 | A1 * | 7/2016 | LeMay | G01N 1/44 |

OTHER PUBLICATIONS

Chinese OA for application No. 201680022494.0 dated Mar. 17, 2020, 9 pages.

* cited by examiner

METHOD FOR CALIBRATING A POWER CONTROL LOOP OF AN INDUCTION HOB

The present invention relates generally to the field of induction hobs. More specifically, the present invention is related to a method for calibrating the power control loop of an induction hob.

BACKGROUND OF THE INVENTION

Induction hobs for preparing food are well known in prior art. Induction hobs typically comprise at least one heating zone which is associated with at least one induction element. For heating a piece of cookware placed on the heating zone, the induction element is coupled with electronic driving means for driving an AC current through the induction element. Said AC current generates a time varying magnetic field. Due to the inductive coupling between the induction element and the piece of cookware placed above the induction element, the magnetic field generated by the induction element causes eddy currents circulating in the piece of cookware. The presence of said eddy currents generates heat within the piece of cookware due to the electrical resistance of said piece of cookware.

In order to control the power provided to the piece of cookware, induction hobs comprise a power control loop. For example, the voltage drop over a shunt resistor may be used as a measurand for controlling the power. However, the power control mechanism may be negatively affected by tolerances of electronic elements included in the power control loop. Said tolerances of electronic elements could be compensated by a manual calibration of the power control loop, which is time-consuming and therefore expensive.

SUMMARY OF THE INVENTION

It is an objective of the embodiments of the invention to provide a method for manufacturing an induction hob at reasonable costs. The objective is solved by the features of the independent claims. Preferred embodiments are given in the dependent claims. If not explicitly indicated otherwise, embodiments of the invention can be freely combined with each other.

According to an aspect, the invention relates to a method for calibrating a power control loop of an induction hob. The induction hob comprises a power stage including at least one induction element, a measurement unit and a control unit. The method comprises the steps of:

- coupling the at least one induction element with a reference load;
- powering the power stage at predefined working conditions by means of said control unit;
- deriving a measurement value being indicative for the power transferred from the power stage to the reference load by means of said measurement unit;
- providing the measurement value to the control unit;
- calculating a correction value based on the measurement value and a reference value;
- storing the correction value in a storage entity in order to modify measurement values provided by the measurement unit based on the correction value when operating the induction hob.

Advantageously, by means of said pre-calculated correction value, an automated and precise calibration of the power control loop included in the induction hob is achieved and no manual calibration, for example, by trimming a potentiometer is necessary.

According to embodiments, the measurement value is derived based on the voltage drop at a shunt resistor being coupled with an arm of a bridge rectifier. By means of said shunt resistor, a measurement value indicative for the power provided from the bridge rectifier to one or more power stages included in the induction hob can be derived. The tolerance of the resistance value of the shunt resistor and other electronic components included in the induction hob may be high, e.g. 5%. Thereby, the electronic component costs of the induction hob can be reduced. By means of said automated calibration process, the tolerances of the electronic components can be compensated thereby obtaining a calibrated power control loop.

According to embodiments, the measurement value is derived based on the voltage drop at a shunt resistor being coupled with a switching element, specifically an insulated-gate bipolar transistor IGBT. Said switching element may be assigned to a certain power stage, i.e. by means of said shunt resistor, a measurement value indicative for the power provided to a certain power stage can be derived. Thus, a precise control power control of a respective power stage is possible. Multiple measurement values may be derived at multiple shunt resistors coupled with different switching elements in order to calibrate multiple power control loops.

According to embodiments, the voltage drop measured at a shunt resistor is received by the measurement unit, the measurement unit providing based on said measured voltage drop the measurement value to the control unit. In other words, the measurement unit converts the measured voltage into a measurement value suitable for the control unit. For example, the measurement unit may amplify the received voltage or may add an offset to said received voltage.

According to embodiments, the reference value and/or correction value is stored in a storage entity, the storage entity being accessible by the control unit. The storage entity may be included in the control unit or may be an external storage entity. The storage entity may comprise a non-volatile storage in order to permanently store the reference value.

According to embodiments, the reference value corresponds to a measurement value provided by the measurement unit based on a m voltage drop over the shunt resistor having a nominal resistance value when powering the power stage at predefined working conditions and coupling the induction element with said reference load. In other words, the reference value may be indicative for the measurement value to be measured if the electronic components, specifically the shunt resistor, have component values (e.g. resistance values) equal to their nominal values (ideal electronic components without tolerances) and the induction element is coupled with said reference load. Thus, said reference value builds the fundamental reference (standard) for the calibration process.

According to embodiments, the correction value is the ratio between the measurement value and the reference value. After determining said correction value, the power control loop can be automatically calibrated by multiplying the currently received measurement value and the correction value.

According to a second aspect, the invention relates to a method for controlling the power transferred from a power stage to a piece of cookware in an induction hob, the induction hob comprising at least one induction element included in said power stage, a measurement unit and a control unit, the method comprising the steps of:

- powering the power stage thereby transferring power to a piece of cookware placed above the induction element;

deriving a measurement value being indicative for the power transferred from the power stage to the piece of cookware by means of said measurement unit;

calculating a power value indicative for the power transferred to a piece of cookware based on the measurement value and a correction value by means of the control unit, the correction value being stored in a storage entity being accessible by said control unit; and controlling the power transferred to the piece of cookware based on the power value.

Advantageously, by using the pre-calculated correction value, an automated and precise control of power transferred to the piece of cookware is achieved.

According to embodiments, the control unit is a software-based control unit comprising at least one processing entity, said processing entity modifying measurement values provided by the measurement circuit based on the correction value. In other words, during the operation of the induction hob a continuous modification of the measurement values is performed in order to derive a power value according to which the power stage is powered.

According to embodiments, the measurement value is derived based on the voltage drop at a shunt resistor being coupled with an arm of a bridge rectifier.

According to embodiments, the measurement value is derived based on the voltage drop at a shunt resistor being coupled with a switching element, specifically an insulated-gate bipolar transistor IGBT.

According to a third aspect, the invention relates to an induction hob comprising a power stage with at least one switching element for enabling an alternating current flow through an induction element, a control unit for controlling the current flow through the induction element and a measurement unit, the measurement unit being adapted to provide a measurement value to the control unit, the measurement value being indicative for the power transferred from the induction element to a piece of cookware placed above the induction element, wherein the control unit is coupled with a storage entity, the storage entity storing a correction value determined during a calibration routine, wherein the control unit is adapted to modify the measurement value based on the correction value and deriving a power value based on the modified measurement value and wherein the control unit is adapted to control the power transferred to the piece of cookware based on the power value.

Advantageously, by calibrating the induction hob during operation by using the pre-calculated correction value, the manufacturing costs can be reduced because cheap electronic components can be used and no manual calibration is necessary.

According to embodiments, the control unit is a software-based control unit comprising at least one processing entity, said processing entity being adapted to modify measurement values provided by the measurement circuit based on the correction value.

According to embodiments, the storage entity comprises a non-volatile data storage.

The term "essentially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
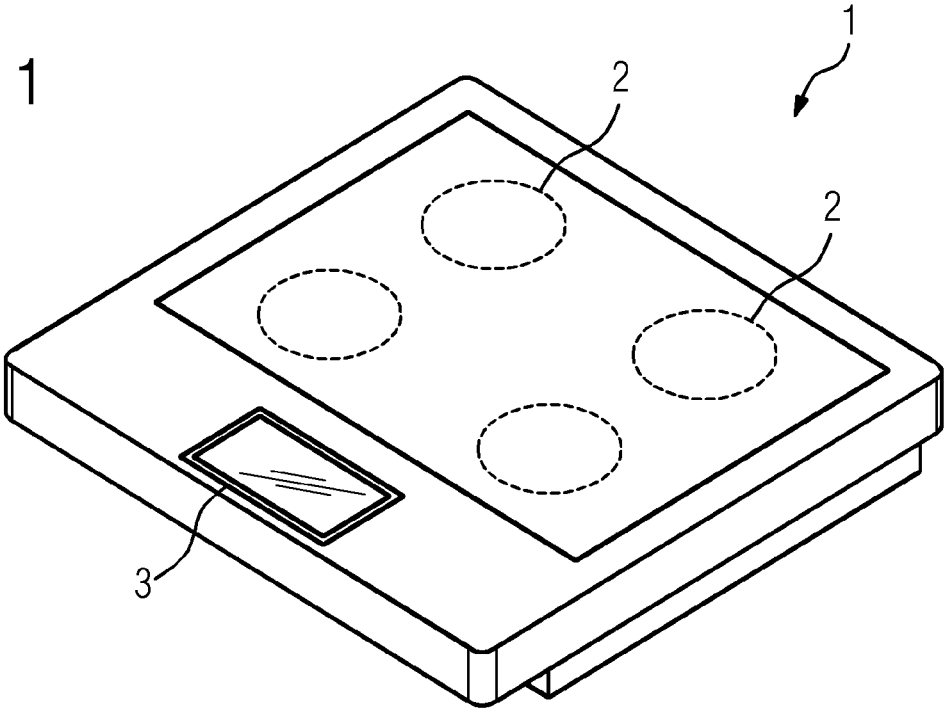
FIG. 1 shows an example schematic view of an induction hob.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 shows a schematic illustration of an induction hob 1 according to the invention. The induction hob 1 may comprise multiple heating zones 2 preferably provided at a common hob plate. Each heating zone is correlated with at least one induction element placed beneath the hop plate. Said induction element may be, for example, an induction coil. The induction hob 1 further comprises a user interface 3 for receiving user input and/or providing information, specifically graphical information to the user.

Figure 2:
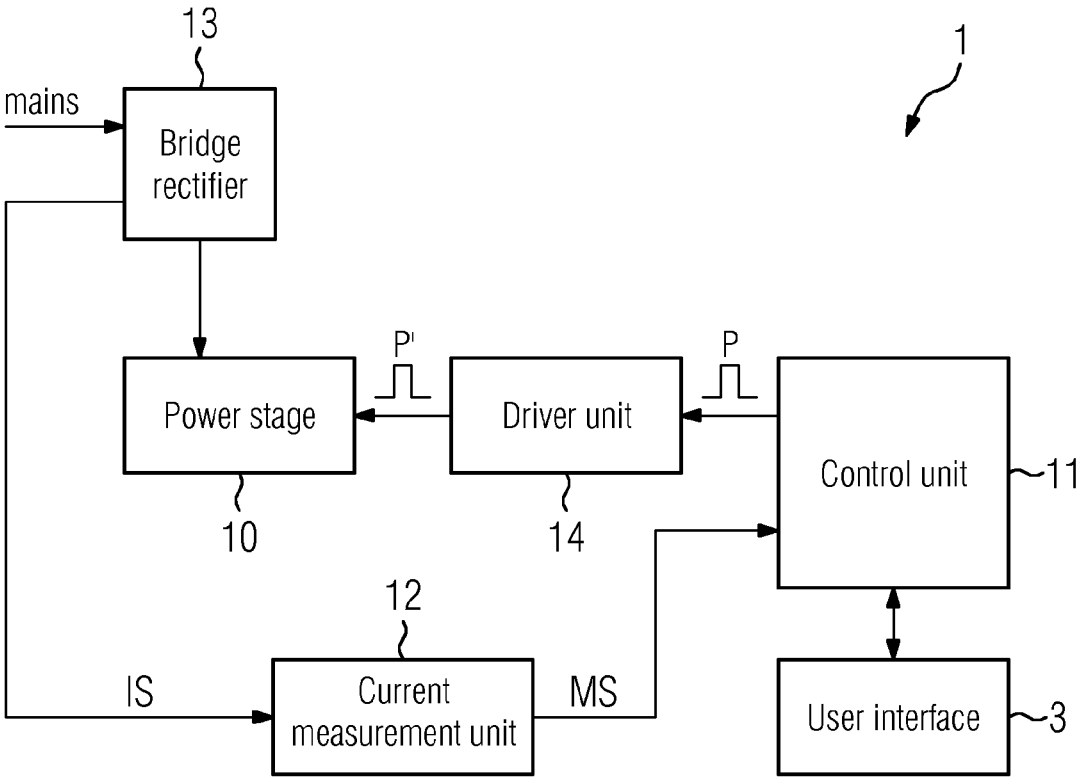
FIG. 2 shows an example schematic block diagram of units comprised within the induction hob.

FIG. 2 shows a schematic block diagram of an induction hob 1 being adapted to measure the current provided to one or more induction elements comprised within the induction hob 1. The induction hob 1 comprises a power stage 10, a control unit 11 and a user interface 3, said user interface 3 being coupled with the control unit 11 in order to provide information to the user and/or to receive information from the user via the user interface 3. Said control unit 11 is coupled with the power stage 10 in order to control the electrical power provided to the power stage 10, specifically to control the power provided to one or more induction elements comprised within the power stage 10.

Furthermore, the induction hob 1 may comprise a bridge rectifier 13, said bridge rectifier 13 being coupled with the power stage 10 for providing electrical power to the induction element of the power stage 10. The bridge rectifier 13 may be coupled with one or more phases of the mains supply network.

According to embodiments, the control unit 11 is coupled with the power stage 10 via a driver unit 14, said driver unit 14 being adapted to receive a pulsed electrical signal P by the control unit 11, modify said received pulsed electrical signal P and provide said modified pulsed electrical signal P' to the power stage 10. According to other embodiments, the control unit 11 may be directly coupled with the power stage 10, i.e. may provide the pulsed electrical signal P directly to the power stage 10. Said pulsed electrical signal P, respectively, modified pulsed electrical signal P' may be applied to a switching element comprised within the power stage 10 in order to enable an alternating current flow through the induction element.

In order to determine the power provided by the power stage 10 to a piece of cookware placed above the induction element of the power stage 10, the induction hob 1 comprises a measurement unit 12. According to an embodiment, the measurement unit 12 is coupled with the bridge rectifier 13 for receiving information regarding the amount of current flowing through the power stage 10. Thereby, the sum of power provided by all power stages 10 can be monitored because said power stages 10 may be powered by a single bridge rectifier 13. According to other embodiments, the measurement unit 12 is coupled with the power stage 10, specifically with the emitter path of the switching element comprised within the power stage 10 in order to receive information regarding the amount of current flowing through said switching element. So, due to the association of one or more switching elements to a certain power stage 10, the power provided by a certain power stage 10 to a piece of cookware can be determined.

The measurement unit 12 is configured to receive an input signal IS, said input signal IS being indicative for the power, specifically, for the amount of current being provided to the power stage 10 and derive a measurement signal MS based on the input signal IS. The measurement unit 12 is further coupled with the control unit 11 in order to provide said measurement signal MS to the control unit 11. The measurement unit 12 is configured to derive a measurement signal MS which can be directly processed by the control unit 11, i.e. the values of the measurement signal MS are adapted to the value range directly processible by the control unit 11. For example, the control unit 11 may be adapted to receive voltage values in the range of 0V to 5V. Therefore, the measurement unit 12 may be adapted to provide measurement signals MS with voltage values within uppermentioned voltage range.

Figure 3:
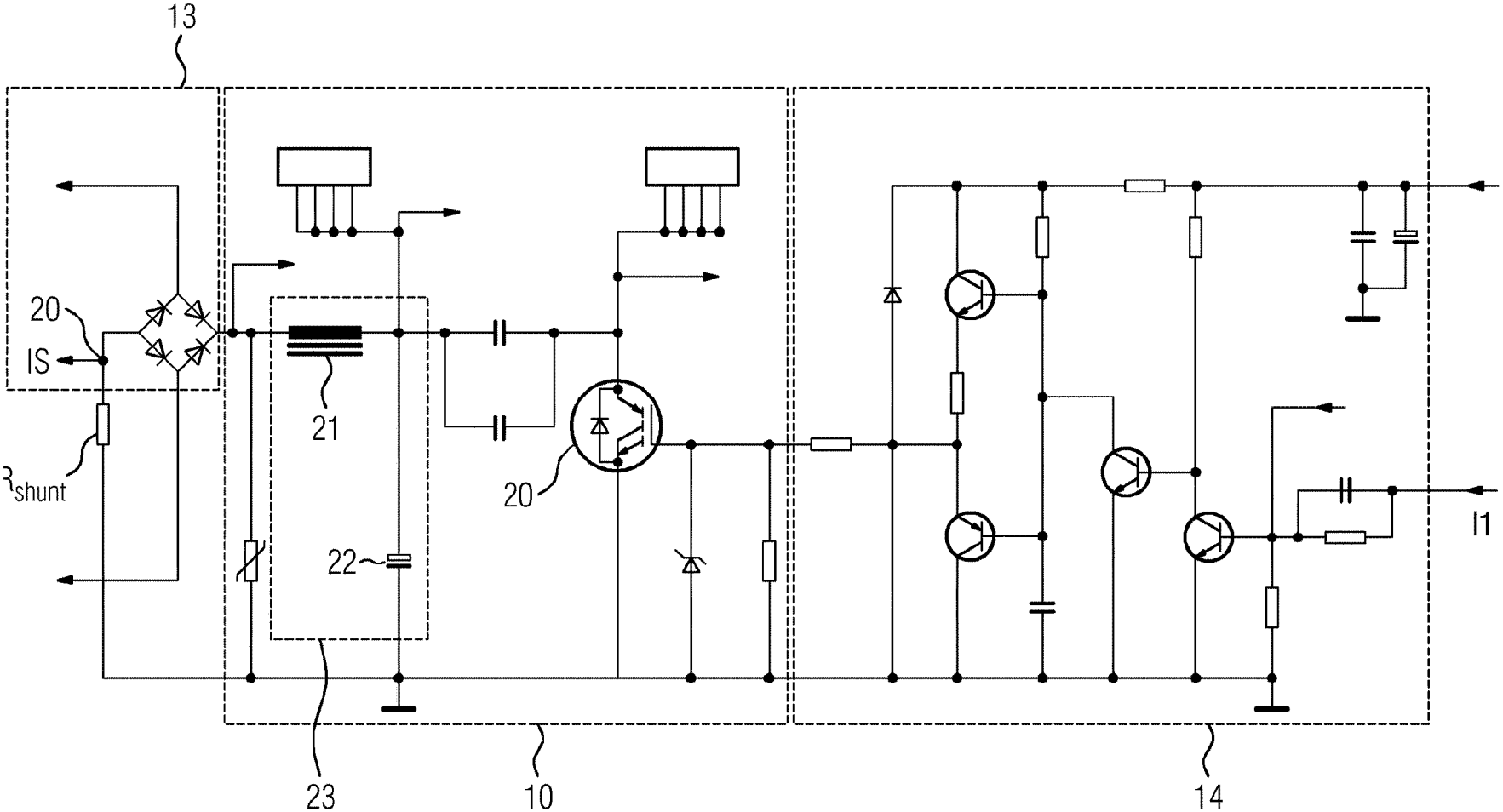
FIG. 3 shows an example circuit diagram of the bridge rectifier, the power stage and the driver unit according to a first embodiment.

FIG. 3 shows the driver unit 14, the power stage 10 and the bridge rectifier 13 in closer detail. The driver unit 14 receives the pulsed electrical signal P at the input port I1. The driver unit 14 comprises an electrical circuitry configured to adapt the received pulsed electrical signal P according to the needs of the power stage 10. For example, the driver unit may amplify the received pulsed electrical signal P and/or may change the signal level of the pulsed electrical signal P by adding a certain offset voltage value to said received pulsed electrical signal P in order to derive said modified pulsed electrical signal P'. Said modified pulsed electrical signal P' may be provided to the gate of the switching element 20. Said switching element 20 may be, for example, an IGBT.

The collector of the switching element 20 may be coupled via a filtering circuitry (comprising one or more capacitors) to an oscillating circuit 23, said oscillating circuit 23 comprising the induction element 21 and a capacitor 22. The power stage 10 may comprise a quasi-resonant power stage architecture. On the opposite side of the capacitor 22, the induction element 21 may be coupled with the bridge rectifier 13 in order to power the oscillating circuit 23 by means of the mains supply network. By enabling a current flow through the switching element 20 using the modified pulsed electrical signal P', an alternating current flow through the induction element 21 is obtained which induces eddy currents in a piece of cookware placed above the induction element 21 thereby providing heat to said induction element 21.

In order to determine the power, specifically, the amount of current provided by the bridge rectifier 13 to the power stage 10, the induction hob 1 comprises a shunt resistor $R_{shunt}$. Said shunt resistor $R_{shunt}$ is coupled on the one hand with the negative port of the bridge rectifier 13, i.e. the node of the bridge rectifier 13 at which the anodes of two adjacent diodes are directly coupled. On the other hand, the shunt resistor $R_{shunt}$ is further coupled with ground. The voltage drop over the shunt resistor $R_{shunt}$ is indicative for the electric current provided by the bridge rectifier 13 to the power stage 10 and might be used as input signal IS of the measurement unit 12.

Figure 4:
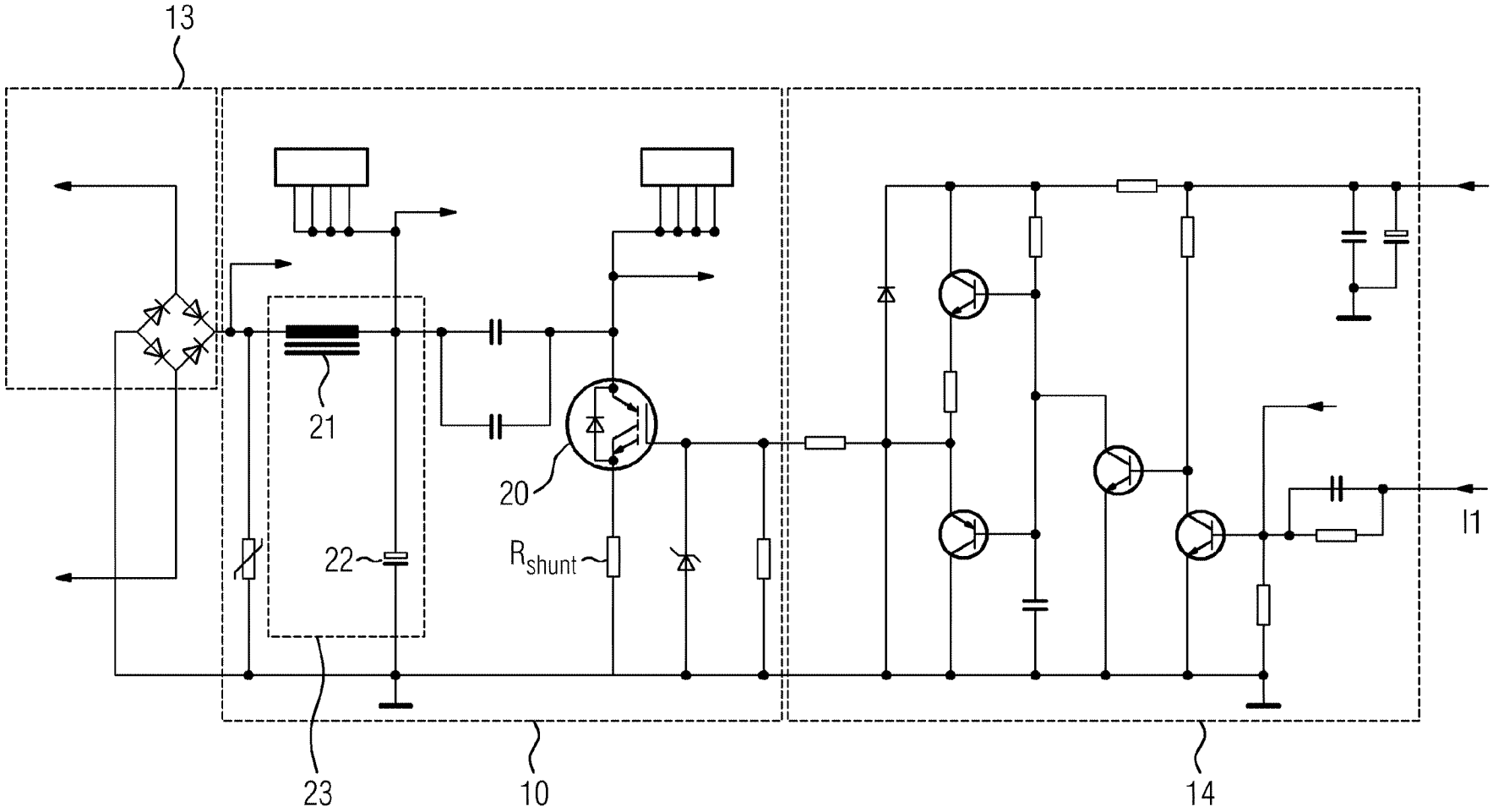
FIG. 4 shows an example circuit diagram of the bridge rectifier, the power stage and the driver unit according to a second embodiment.

FIG. 4 shows a further embodiment of a circuitry including the driver unit 14, the power stage 10 and the bridge rectifier 13 similar to FIG. 3. So, in the following only different technical features of the embodiment of FIG. 4 are explained. Apart from that, reference is made to the description of technical features of the circuitry according to FIG. 3. The main difference between the circuitries of FIG. 3 and FIG. 4 is the arrangement of the shunt resistor $R_{shunt}$. According to the circuitry of FIG. 4, the shunt resistor $R_{shunt}$ is included in the emitter path of the switching element 20. Thereby, it is possible to determine the current (based on the voltage drop over the shunt resistor $R_{shunt}$) flowing through the switching element 20. Said current value is a measure for the power provided from the induction element of the power stage 10 to the piece of cookware placed above said induction element. Due to the integration of the shunt resistor into the power stage, the power provided by each power stage can be determined separately.

In case that the tolerance of the nominal value of the shunt resistor $R_{shunt}$ is high (e.g. 5%), the power value derived by measuring the voltage drop over said shunt resistor $R_{shunt}$ also has a high error deviation, i.e. the determined power value is not precise but shows also a inaccuracy which may be not acceptable for power control purposes.

Figure 5:
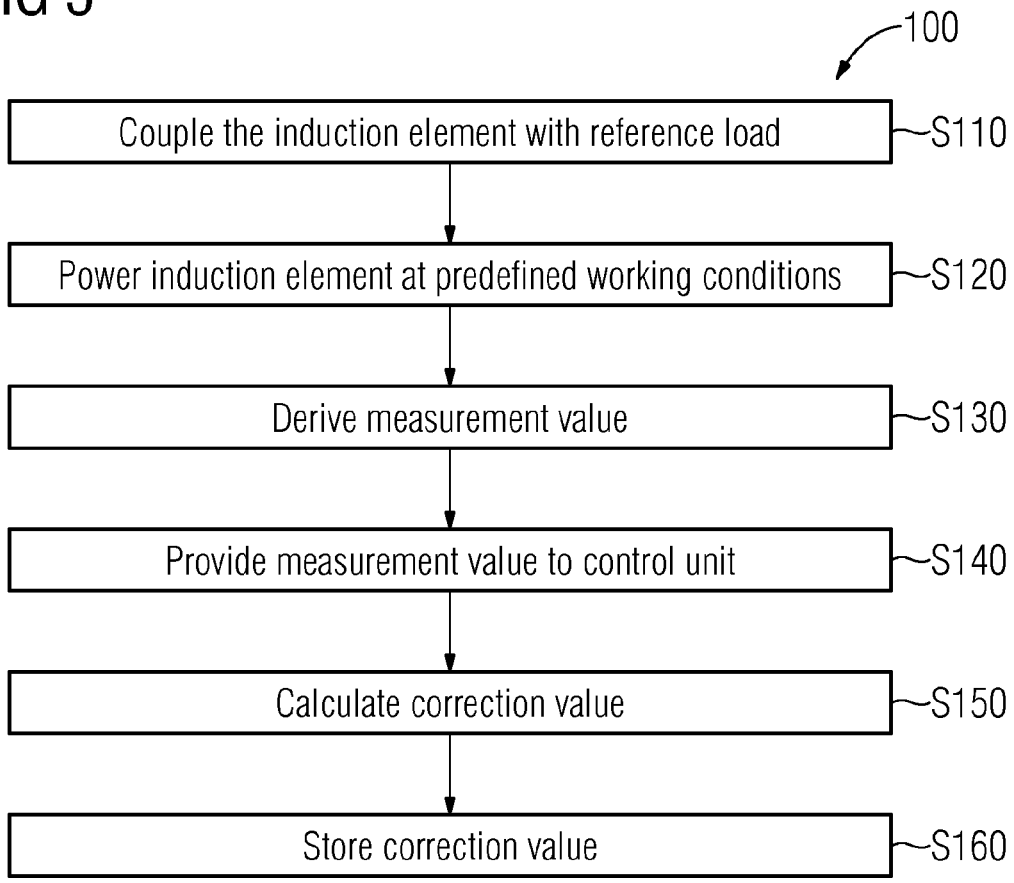
FIG. 5 illustrates an example method for calibrating a power control loop of an induction hob based on a flow chart.

FIG. 5 illustrates a method 100 for running an induction hob calibration, specifically an automatic induction hob calibration. Said calibration may be a factory calibration performed in production plant after at least partially assembling the induction hob 1.

First, the induction element 21 is coupled with a reference load (S110). Said reference load may be made of a ferromagnetic material and may comprise predetermined load properties in order to constitute a calibration load. For example, the reference load may be placed on the heating zone 2 which is associated with said induction element 21.

After coupling the induction element 21 with the reference load, the power stage 10 including the induction element 21 coupled with the reference load is powered (S120). Specifically, the induction element 21 is powered at predefined working conditions by means of the control unit 11 and the driver unit 14. Said predefined working conditions may cause a preset transfer of electric power to the induction element 21. The predefined working conditions may specify a certain electrical signal P or a certain modified certain electrical signal P', for example, with a certain pulse duration and a certain pulse amplitude.

When powering the power stage 10 at predefined working conditions, a measurement value is derived, said measurement value being indicative for the power transferred from the induction element 21 to the reference load (S130). Said measurement value may be derived at a shunt resistor $R_{shunt}$, i.e. the measurement value may be a voltage value indicating the voltage dropping at said shunt resistor $R_{shunt}$. As shown in FIGS. 3 and 4, the shunt resistor $R_{shunt}$ may be included in the emitter path of the switching element 20 or may be coupled with the bridge rectifier 13. Alternatively, the measurement value may be obtained by the measurement unit 12 based on the voltage dropping at the shunt resistor.

Following up, the measurement value is provided to the control unit 11 (S140). The control unit 11 may start a calibration routine based on said measurement value. For example, the control unit 11 may compare the measurement value with a reference value. Said reference value may be stored in a storage entity coupled with the control unit 11. The reference value may be obtained as a measurement value if the real value of the shunt resistor $R_{shunt}$ is the nominal value of the shunt resistor $R_{shunt}$, i.e. the resistance value of the shunt resistor $R_{shunt}$ does not deviate from its nominal value (error deviation 0%) and the induction element is coupled with the reference load.

Based on the measurement value and the reference value, the control unit 11 may calculate a correction value (S150). For example, the correction value may be the ratio between the measurement value and the reference value. Due to the proportional dependency of the measurement value from the resistance value of the shunt resistor $R_{shunt}$, the correction value indicates the ratio between the real resistance value of the shunt resistor $R_{shunt}$ and its nominal value.

Finally, the correction value is stored in a storage entity coupled with the control unit 11 (S160). The control unit 11 may have access to said storage entity in order to read out said correction value from the storage entity and modify measurement values derived when operating the induction hob 1 (e.g. after putting the induction hob into operation by a user) based on said correction value. For example, a measurement value may be multiplied with the correction value in order to obtain a modified measurement value. Thereby, a calibration of the power control loop included in the induction hob is obtained.

It is worth mentioning that upper-mentioned calibration routine has to be performed for each shunt resistor $R_{shunt}$ separately, i.e. for each shunt resistor $R_{shunt}$ a correction value is determined and stored for calibrating the power measurement performed by using said shunt resistor $R_{shunt}$.

Figure 6:
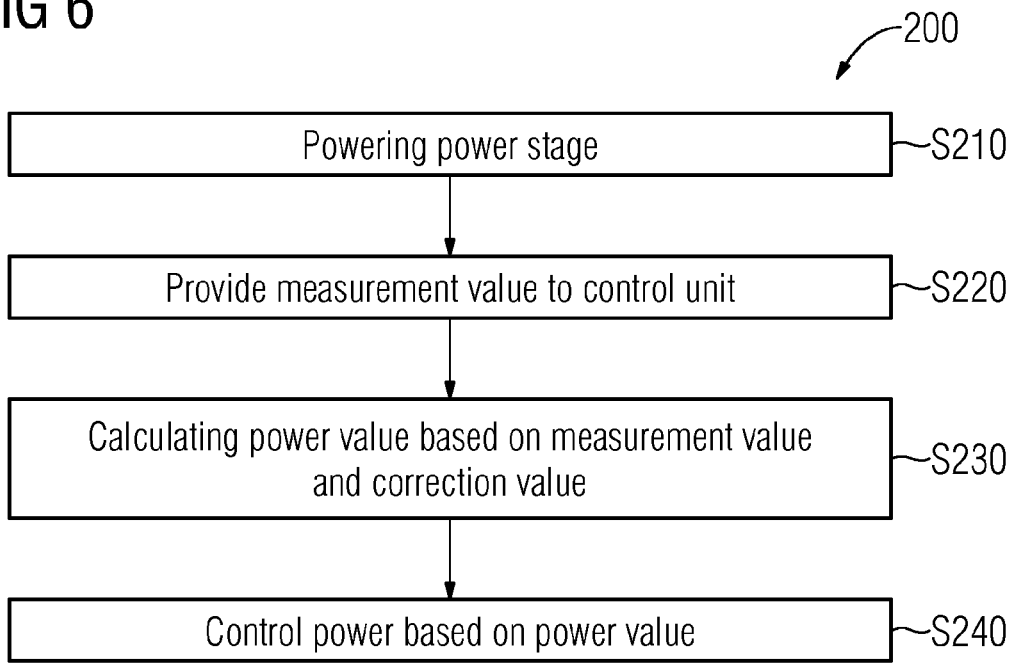
FIG. 6 illustrates an example method for controlling the power transferred to a piece of cookware in an induction hob.

FIG. 6 illustrates a method 200 for measuring the power transferred to a piece of cookware. First the power stage 10 is powered (S210) in order to transfer power from the induction element 21 to a piece of cookware placed above the induction element 21. During said powering, at least one measurement value is provided to the control unit 11 (S220). Said measurement value is indicative for the power transferred to the piece of cookware. Preferably, measurement values may be continuously provided to the control unit 11 in order to continuously monitor the power level. As already mentioned before, the measurement value may be derived at a shunt resistor $R_{shunt}$, i.e. the measurement value may be the voltage dropping at said shunt resistor $R_{shunt}$, or the measurement value may be provided by the measurement unit by adjusting the voltage measured at the shunt resistor.

The control unit may be adapted to calculate a power value based on said measurement value and a correction value (S230). The power value may be indicative for the actual power transferred from the power stage 10 to a piece of cookware. The correction value may have been obtained during calibrating routine and may be stored in a storage entity. For example, a modified measurement value may be calculated based on the measurement value. The modified measurement value may be, for example, the measurement value multiplied with/divided by the correction value. The power value may be calculated based on said modified measurement value.

Finally, said power value may be used for controlling the power transferred from the power stage 10 to the piece of cookware (S240). In other words, the power control of the induction hob 1 may use a modified measurement value for controlling the power transferred to the piece of cookware.

Figure 7:
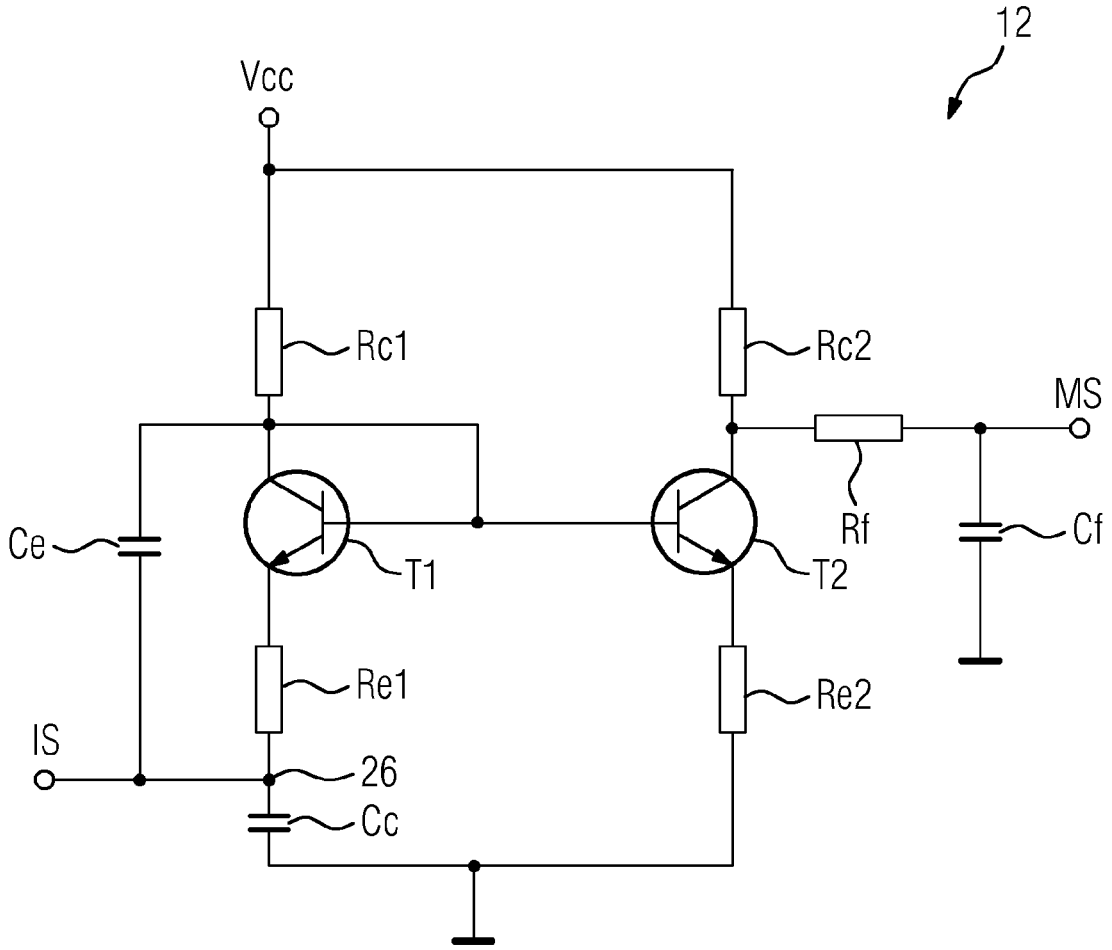
FIG. 7 shows an example circuitry of the measurement unit.

FIG. 7 shows an example circuitry comprised within the measurement unit 12. Said measurement unit circuitry may be used for the circuitries according to FIGS. 3 and 4. The measurement unit 12 solely comprises discrete components like resistors, capacitors and transistors, i.e. there are no integrated circuits, e.g. operational amplifiers etc. The measurement unit 12 comprises two transistors T1, T2 which are coupled in a current-mirror-circuit-like manner. The measurement unit 12 further comprises an input for receiving the input signal IS. Said input signal is received at the emitter path of the first transistor T1. The transistors may be, for example, bipolar transistors of an n-p-n type. The measurement unit 12 is powered by a supply voltage Vcc, wherein Vcc is, for example, 5V.

The collector of the first transistor T1 is coupled with the supply voltage Vcc via a first collector resistor Rc1. The emitter path of said first transistor T1 comprises a first emitter resistor Re1 and an emitter capacity Ce, wherein the first emitter resistor Re1 is coupled at a first contact with the emitter of the first transistor T1 and at a second contact with the emitter capacity Ce. The emitter capacity Ce is coupled at a further contact opposite to the first emitter resistor Re1 with ground. In other words, the first emitter resistor Re1 and the emitter capacity Ce are serially coupled within the emitter path of the first transistor T1.

The second transistor T2 also comprises a collector path and an emitter path. The collector path comprises a second collector resistor Rc2, the second collector resistor Rc2 being coupled with one resistor contact with the supply voltage Vcc and with the further contact with the collector of the second transistor T2. The measurement signal MS may be derived at the collector of the second transistor T2, i.e. at the node between the collector of the second transistor T2 and the second collector resistor Rc2. In the emitter path of the second transistor T2, a second emitter resistor Re2 is arranged wherein the emitter of the second transistor T2 is coupled with ground via said second emitter resistor Re2.

Furthermore, the bases or gates (in case of using field effect transistors) are directly coupled with each other, i.e. coupled via an electrical connection without any electrical device. In addition, there is also a direct electrical connection (without any electrical device) between the collector and the base or gate of the first transistor T1. Thereby, the voltage applied to the collector of the first transistor T1 is equal to the voltage applied to the bases or gates of the first and second transistor T1, T2.

For deriving the measurement signal MS based on the input signal IS, the input of the measurement unit 12 is coupled with node 25 between the bridge rectifier 13 and the power stage 10. Keeping in mind the flow direction of the electric current through the shunt resistor $R_{shunt}$, the voltage $U_{Rshunt}$ is negative. Thereby, also the input signal IS comprises a negative voltage with respect to ground level. So, in case that the current flowing through the bridge rectifier 13 is rising, the voltage $U_{Rshunt}$ is also rising, i.e. the voltage at node 26 between the first emitter resistor Re1 and the emitter capacity Ce is increasing in the negative range. Thereby, also the current flowing through the first transistor T1 is rising.

Due to the upper-mentioned coupling of the first and second transistor T1, T2, the rising of the electric current flowing through the first transistor T1 may cause a rising current flow through the second transistor T2. The rising current flow through the second transistor T2 causes a rising voltage at the collector of said second transistor T2, i.e. the measurement signal MS also shows a rising voltage.

Conversely, a decreasing current flow through the bridge rectifier 13 may cause a reduced current flow through the second transistor T2 and therefore may cause a decreasing voltage at the collector of said second transistor T2, i.e. the measurement signal MS also shows a decreasing voltage.

Due to switching the switching element 20 based on the pulsed electrical signal P and the high currents flowing through the induction element 21, the current measurement within the measurement unit 12 is very noisy, i.e. the input signal IS may vary due to parasitic side effects which may worsen the measurement results provided by the measurement unit 12. In order to suppress said noise, the measurement unit 12 comprises several capacitors which suppress said input signal fluctuations and/or measurement signal fluctuations. At the input of the measurement unit 12 signal fluctuations of the input signal IS maybe suppressed by the emitter capacitor Ce comprised within the emitter path of the first transistor T1. As already mentioned above, the emitter capacitor Ce may be arranged between the first emitter resistor Re1 and ground. Thereby, the emitter capacitor Ce is connected in parallel to the shunt resistor $R_{shunt}$. In addition, at the input of the measurement unit 12, a collector capacitor Cc may be provided which connects the input of the measurement unit 12 with the collector of the first transistor T1. Said emitter capacitor Ce and said collector capacitor Cc may lower signal fluctuations of the input signal IS.

Furthermore, the measurement unit 12 comprises a low pass filter 24, said low pass filter 24 being provided at the output of the measurement unit 12, i.e. the low pass filter is connected with the collector path of the second transistor T2. For example, the low pass filter 24 comprises a resistor Rf and a capacitor Cf forming a passive first-order low pass filter. Of course, also other low pass filters may be used. By means of said low pass filter 24, a smoothing of the measurement signal MS is achieved. In other words, the low pass filter 24 provides an averaged measurement signal MS thereby filtering out high-frequency signal fluctuations. For example, the low pass filter 24 may be chosen such that the variations of the measurement signal MS are very slow with respect to the timing of the control unit 11.

It should be noted that the description and drawings merely illustrate the principles of the proposed methods and systems. Those skilled in the art will be able to implement various arrangements that, although not explicitly described or shown herein, embody the principles of the invention.

LIST OF REFERENCE NUMERALS

1 induction hob
2 heating zone
3 user interface
10 power stage
11 control unit
12 measurement unit
13 bridge rectifier
14 driver unit
20 switching element
21 induction element
22 capacitor
23 oscillating circuit
24 low-pass filter
25 node
26 node
100 calibration method
S110-S160 calibration method steps
200 power measuring method
S210-S240 power measuring method steps
Cc collector capacitor
Ce emitter capacitor
Cf capacitor
I1 input
IS input signal
MS measurement signal
P pulsed electrical signal
P' modified pulsed electrical signal
Rc1 first collector resistor
Rc2 second collector resistor
Re1 first emitter resistor
Re2 second emitter resistor
Rf resistor
$R_{shunt}$ shunt resistor
T1 first transistor
T2 second transistor
$U_{Rshunt}$ voltage over $R_{shunt}$
Vcc supply voltage

The invention claimed is:

1. Method for calibrating a power control loop of an induction hob, the induction hob comprising a power stage including at least one induction element, a measurement unit and a control unit, the method comprising the steps of:

coupling the at least one induction element with a reference load by inductance formed therebetween;

powering the power stage at predefined working conditions by means of said control unit;

deriving a measurement value being indicative for power transferred from the power stage to the reference load by the inductance formed therebetween by means of said measurement unit;

providing the measurement value to the control unit;

calculating a correction value based on the measurement value and a reference value;

storing the correction value in a storage entity in order to modify measurement values provided by the measurement unit based on the correction value when operating the induction hob.

2. Method according to claim 1, wherein the measurement value is derived based on a voltage drop at a shunt resistor being coupled with an arm of a bridge rectifier.

3. Method according to claim 1, wherein the measurement value is derived based on a voltage drop at a shunt resistor being coupled with a switching element.

4. Method according to claim 2, wherein the voltage drop measured at a shunt resistor is received by the measurement unit, the measurement unit providing the measurement value based on said voltage drop.

5. Method according to claim 1, wherein the reference value is stored in a storage entity, the storage entity being accessible by the control unit.

6. Method according to claim 2, wherein the reference value corresponds to a measurement value provided by the measurement unit based on a voltage drop over the shunt resistor having a nominal resistance value when powering the power stage at predefined working conditions and coupling the induction element with said reference load.

7. Method according to claim 1, wherein the correction value is a ratio between the measurement value and the reference value.

8. Method according to claim 3, wherein the switching element is an insulated-gate bipolar transistor IGBT.

9. Method for controlling power transferred from a power stage to a piece of cookware in an induction hob, the induction hob comprising at least one induction element included in said power stage, a measurement unit and a control unit, the method comprising the steps of:

powering the power stage thereby transferring power to a piece of cookware placed above the induction element;

deriving a measurement value being indicative for the power transferred from the power stage to the piece of cookware by means of said measurement unit;

obtaining a correction value that is calculated based on a reference value and a test value being indicative for power transferred from the power stage to a reference load when the at least one induction element is coupled with the reference load by inductance formed therebetween;

calculating a power value indicative for the power transferred to a piece of cookware based on the measurement value and a correction value by means of the control unit, the correction value being stored in a storage entity being accessible by said control unit; and controlling the power transferred to the piece of cookware based on the power value.

10. Method according to claim 9, wherein the control unit is a software-based control unit comprising at least one processing entity, said processing entity modifying measurement values provided by the measurement unit based on the correction value.

11. Method according to claim 9, wherein the measurement value is derived based on a voltage drop at a shunt resistor being coupled with an arm of a bridge rectifier.

12. Method according to claim 9, wherein the measurement value is derived based on a voltage drop at a shunt resistor being coupled with a switching element.

13. Method according to claim 11, wherein the voltage drop measured at a shunt resistor is received by the measurement unit, the measurement unit providing the measurement value based on said voltage drop.

14. Method according to claim 12, wherein the switching element is an insulated-gate bipolar transistor IGBT.

15. Induction hob comprising:

a power stage with at least one switching element for enabling an alternating current flow through an induction element, a control unit for controlling the alternating current flow through the induction element and a measurement unit, the measurement unit being adapted to provide a measurement value to the control unit, the measurement value being indicative for power transferred from the induction element to a piece of cookware placed above the induction element, wherein the control unit is coupled with a storage entity, the storage entity storing a correction value determined during a calibration routine, wherein the correction value is calculated based on a reference value and a test value being indicative for power transferred from the power stage to a reference load that is located when the at least one induction element is coupled with the reference load by inductance formed therebetween;

wherein the control unit is adapted to calculate a modified measurement value by applying the correction value to the measurement value and to derive a power value based on the modified measurement value and wherein the control unit is adapted to control the power transferred to the piece of cookware based on the power value.

16. Induction hob according to claim 15, wherein the control unit is a software-based control unit comprising at least one processing entity, said processing entity being adapted to modify measurement values provided by the measurement unit based on the correction value.

17. Induction hob according to claim 15, wherein the storage entity comprises a non-volatile data storage.

* * * * *